US008231782B2

(12) United States Patent
Dietschreit

(10) Patent No.: US 8,231,782 B2
(45) Date of Patent: Jul. 31, 2012

(54) SUPPORT BASKET OF A SCREEN CENTRIFUGE

(75) Inventor: Horst Dietschreit, Muelheim an der Ruhr (DE)

(73) Assignee: Seibtechnik GmbH (DE)

( * ) Notice: Subject to any disclaimer, the term of this patent is extended or adjusted under 35 U.S.C. 154(b) by 614 days.

(21) Appl. No.: 12/439,950

(22) PCT Filed: Jun. 2, 2007

(86) PCT No.: PCT/EP2007/004912

§ 371 (c)(1),
(2), (4) Date: Mar. 4, 2009

(87) PCT Pub. No.: WO2008/052602

PCT Pub. Date: May 8, 2008

(65) Prior Publication Data

US 2009/0275459 A1 Nov. 5, 2009

(30) Foreign Application Priority Data

Oct. 31, 2006 (DE) ..... 10 2006 051 236

(51) Int. Cl.
*B04B 7/14* (2006.01)
*B04B 7/16* (2006.01)

(52) U.S. Cl. ..... 210/232; 210/360.1; 210/380.1; 494/36

(58) Field of Classification Search ..... 494/36; 210/232, 360.1, 380.1
See application file for complete search history.

(56) References Cited

U.S. PATENT DOCUMENTS

| | | | |
|---|---|---|---|
| 6,514,421 | B2 | 2/2003 | Leung et al. |
| 2003/0234214 | A1 | 12/2003 | Mullins |

FOREIGN PATENT DOCUMENTS

| | | | |
|---|---|---|---|
| DE | 2941538 | A1 | 4/1981 |
| DE | 3209309 | A1 | 9/1983 |
| DE | 19651635 | A1 | 6/1998 |
| DE | 102004057859 | A1 | 6/2006 |
| GB | 2033242 | A | 5/1980 |
| JP | 2005205277 | A | 8/2005 |
| WO | WO 2008052602 | A1 * | 5/2008 |

OTHER PUBLICATIONS

Written Opinion of the International Searching Authority for PCT/EP07/004912, dated Aug. 24, 2007.*
International Search Report for PCT/EP2007/004912.

* cited by examiner

*Primary Examiner* — David A Reifsnyder
(74) *Attorney, Agent, or Firm* — Brooks Kushman P.C.

(57) ABSTRACT

The invention relates to an outer support basket of the centrifuge basket of a screen centrifuge, wherein screen segments can be secured by conical means in the support basket, the support basket has a plurality of concentric support rings with a rectangular cross section with greater width than thickness and the broad sides of the rings lie parallel to one another and at right angles to the basket axis, wherein the support rings are spaced apart from one another by axially parallel rods which run through the support rings.

11 Claims, 2 Drawing Sheets

SUPPORT BASKET OF A SCREEN CENTRIFUGE

Figure 3:
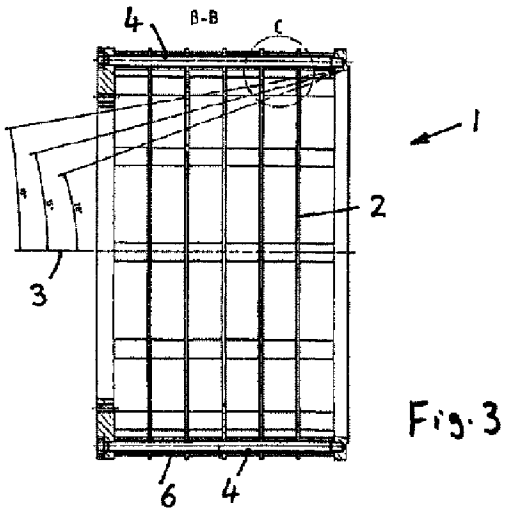

The invention relates to an outer support basket of the centrifuge basket of a screen centrifuge, wherein screen segments can be fastened conically in the support basket, the support basket has a plurality of concentric support rings with a rectangular cross section with a width which is greater than the thickness, and the broad sides of the rings are located parallel to one another and at right angles to the basket axis.

It is known, in the case of centrifuges, for the screen segments to be arranged conically within the support basket and to be retained by an outer supporting structure which covers parts of the screen surface area, in which case the effective screen surface area which remains free is significantly reduced. It is also the case with the known support baskets that the wear to which the supporting structure is subjected by the screening material poses a problem.

It is an object of the invention to improve the support basket of the centrifuge such that, along with a straightforward design and assembly, easy exchangeability and a low level of wear, the largest possible screen surface area remains free.

This object is achieved according to the invention in that the support rings are spaced apart from one another by axis-parallel rods which run through the support rings.

The rods, which are parallel to the basket axis, allow a particularly straightforward design along with easy production and assembly. The rods do not cover the outside of the screen surface, in which case the screen surface has its outside butting only against the narrow sides or inner edges of the support rings.

Straightforward dismantling also provides for easy exchange of the individual parts, in particular of the worn parts.

Particularly straightforward assembly and dismantling is achieved when the first and/or last support ring or rings are or is fastened in a releasable manner on the rods, in particular screwed thereto.

An extremely straightforward design is achieved if the support rings are plugged on the rods, and sleeves for spacing apart the support rings are located on the rods between the support rings. It is possible here for the sleeves to be made of metal and to have an outer ceramic-material layer, in which case the rods are reliably protected against wear. As an alternative to this, it is possible for the sleeves to be made of metal and be enclosed externally by a sleeve made of resistant material, in particular of ceramic material.

A further particularly advantageous design is achieved when the support rings are retained on the rods by protrusions, nuts and/or pins, and sleeves made of a resistant material, in particular a ceramic material, are located on the rods between the support rings.

It is preferably proposed for the support rings to have an essentially identical external diameter and an internal diameter which decreases in the direction of one basket end.

Figure 4:
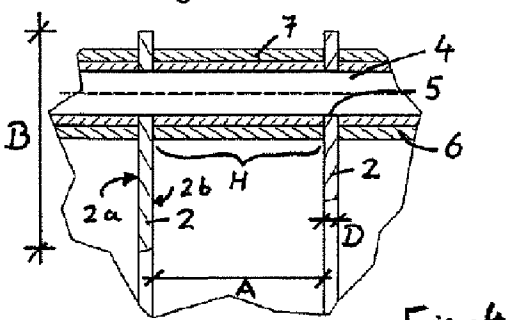
Figure 2:
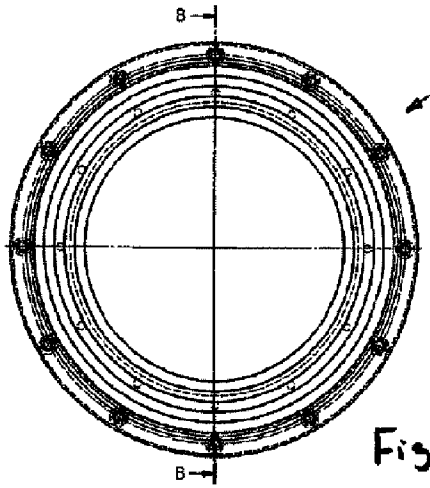
Figure 1:
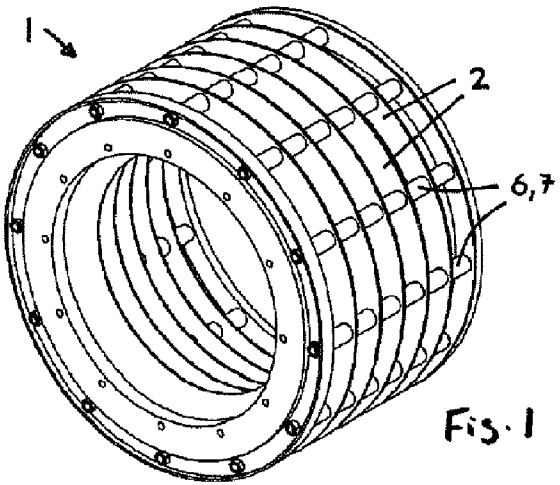
Figures 5, 6, 7, 8, 9:
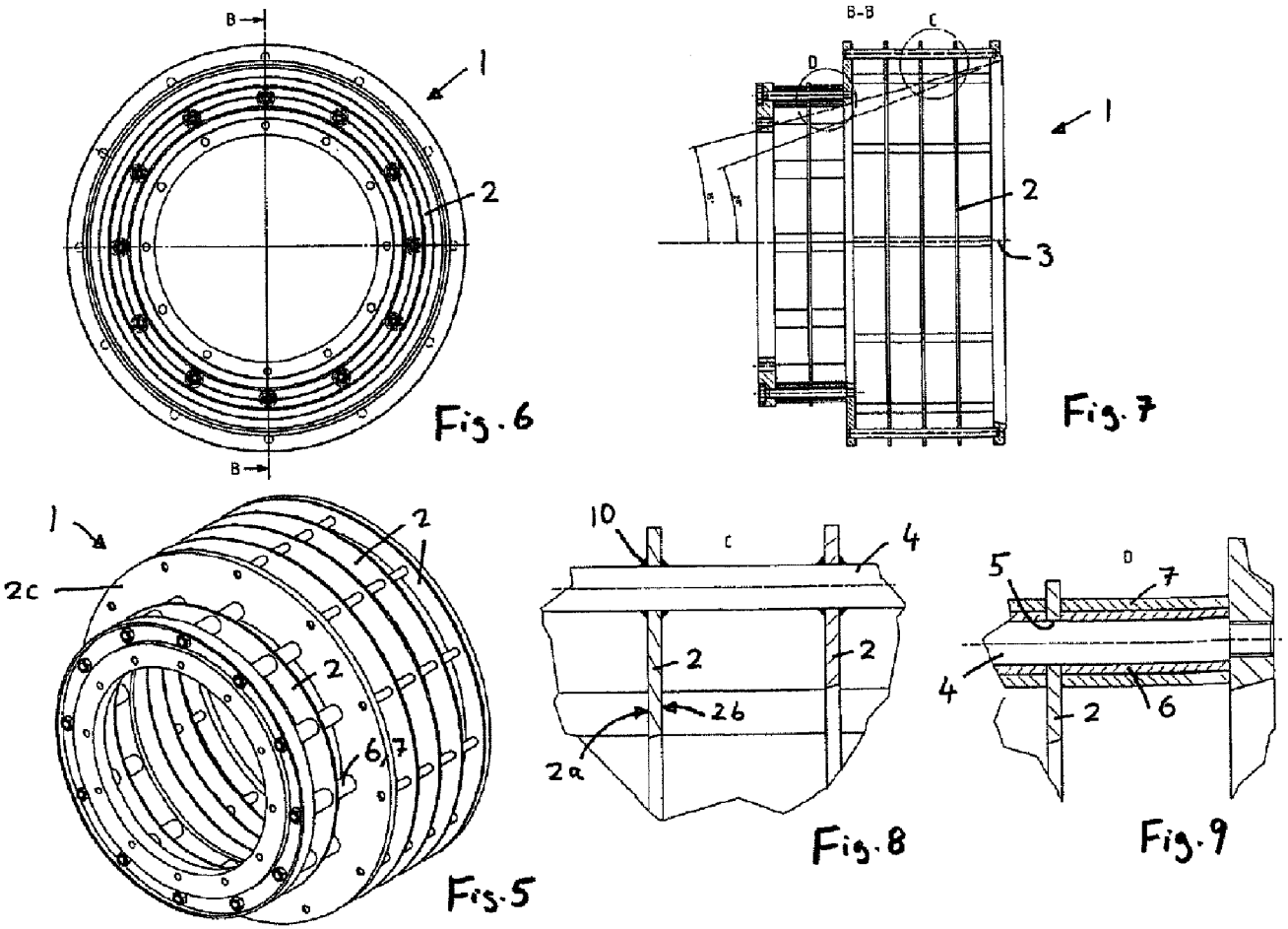

Exemplary embodiments of the invention are described in more detail hereinbelow and are illustrated in the drawings, in which:

FIG. 1 shows a perspective view of a centrifuge basket with a constant external diameter, FIG. 2 shows a side view of the centrifuge basket according to FIG. 1, FIG. 3 shows the centrifuge basket according to FIG. 1 as seen in axial section B-B, FIG. 4 shows the enlarged detail C from FIG. 3, FIG. 5 shows a perspective view of a second configuration of a centrifuge basket, this time with a stepped portion, FIG. 6 shows a side view of the centrifuge basket according to FIG. 5, FIG. 7 shows the centrifuge basket according to FIG. 5 as seen in axial section B-B, FIG. 8 shows the enlarged detail C from FIG. 7, and FIG. 9 shows the enlarged detail D from FIG. 7.

In the first exemplary embodiment, which is illustrated in FIGS. 1 to 4, the support basket 1 of a centrifuge basket has a plurality of coaxial support rings 2 which are made of sheet metal, on which screen segments (not illustrated) are located on the inside and of which the broad sides 2*a*, 2*b* are arranged parallel to those of the other support rings and at right angles to the basket axis 3, in which case basket radii are located in the planes of the broad sides 2*a*, 2*b* of the rings. The support rings 2 thus have a low height or thickness D parallel to the basket axis and a width B, which is a multiple of the thickness D, in the radial direction.

These support rings 2 which are flat in the axial direction are arranged at regular, preferably equal, spacing A over the axial length of the support basket, the annular width B of support rings 2 increasing or staying the same with the internal diameter decreasing in the direction of the tapered end of the conical screen, in which case the support rings 2 form a conical shape on the inside for externally supporting the screen or screen covering.

Axis-parallel metal rods 4 are plugged at regular spacings through holes 5 in the support rings 2 or, during assembly, the support rings are pushed one after the other onto these rods 4, the holes 5 always being introduced in the support rings at the same radial spacing from the basket axis 3.

Metal sleeves 6, of which the height H corresponds to the spacing A between the support rings 2, are plugged onto the rods 4 here. Either the sleeves 6 are provided externally with a ceramic-material layer or ceramic sleeves 7 of equal height H to the sleeves 6 are arranged externally over the sleeves 6, in order to protect the sleeves 6 against wear.

In a configuration which is not illustrated, there is no need for the metal sleeves 6 as spacers if the support rings 2 are fastened against displacement on the rods 4 guided through them. This fastening is done by threaded nuts on the rods 4, by pin connections by welding 10 and/or by protrusions on the rods. In these cases, the metal sleeves 6 are dispensed with and are replaced by ceramic-material sleeves of the same height H.

At least one end of the metal rods 4 has, or both ends of the metal rods 4 have, an external thread, onto which a threaded nut 8 is screwed in order to retain in each case the outermost support ring 2. This aids straightforward assembly and dismantling.

The exemplary embodiment according to FIGS. 6 to 9 differs from the previous exemplary embodiment solely by the fact that, rather than all the support rings 2 having the same external diameter, the support rings closer to the tapered end have a smaller external diameter. For this purpose, the support rings 2 of the reduced-diameter basket region have plugged through them further retaining rods 4 which are spaced apart from the basket axis 3 by a smaller radial spacing than the rest of the retaining bars. A support ring 2*c*, which forms the transition to the reduced-diameter region, thus has holes for the rods 4 of both support-basket regions.

The invention claimed is:

1. An outer support basket of the centrifuge basket of a screen centrifuge which is rotatable about a basket axis, the support basket comprising a plurality of concentric support rings with a rectangular cross section with a radial width which is greater than the thickness, and the broad sides of the rings are located parallel to one another and at right angles to the basket axis, characterized in that the support rings have an essentially identical external diameter an internal diameter which decreases in the direction of one basket end, wherein screen segments can be fastened conically to the support rings.

2. The support basket as claimed in claim 1, characterized in that the first and/or last support ring or rings are or is fastened in a releasable manner on the rods.

3. The support basket as claimed in claim 1, characterized in that the support rings are plugged on the rods, and sleeves for spacing apart the support rings are located on the rods between the support rings.

4. The support basket as claimed in claim 3, characterized in that the sleeves are made of metal and have an outer ceramic-material layer.

5. The support basket as claimed in claim 3, characterized in that the sleeves are made of metal and are enclosed externally by a sleeve made of resistant material.

6. The support basket as claimed in claim 1, characterized in that the support rings are retained on the rods by protrusions, nuts and/or pins, and sleeves made of a resistant material, in particular a ceramic material, are located on the rods between the support rings.

7. The support basket as claimed in claim 1, further comprising a plurality of rods radially spaced from and axially extending parallel to the basket axis for holding the support rings in spaced apart orientation and a plurality of threaded fasteners cooperating with the rods to retain the support rings.

8. The support basket as claimed in claim 7, further comprising a plurality of sleeves located on the rods between the support rings for spacing apart the support rings.

9. The support basket as claimed in claim 8, wherein the sleeves are made of metal and have an outer ceramic material layer.

10. The support basket as claimed in claim 8, wherein the sleeves are made of metal and are enclosed externally by a sleeve made of resistant material, in particular of ceramic material.

11. The support basket as claimed in claim 7, further comprising a plurality of sleeves located on the rods between the support rings for spacing apart the support rings wherein the sleeves are made of a ceramic material.

* * * * *

UNITED STATES PATENT AND TRADEMARK OFFICE

CERTIFICATE OF CORRECTION

PATENT NO. : 8,231,782 B2
APPLICATION NO. : 12/439950
DATED : July 31, 2012
INVENTOR(S) : Horst Dietschreit It is certified that error appears in the above-identified patent and that said Letters Patent is hereby corrected as shown below:

On the face of the Patent:

Delete "(73) Assignee: Seibtechnik GmbH (DE)"

and insert -- (73) Assignee: Siebtechnik GmbH (DE) --

Signed and Sealed this
Twelfth Day of March, 2013

Teresa Stanek Rea
*Acting Director of the United States Patent and Trademark Office*